US006224052B1

(12) United States Patent
Nagano

(10) Patent No.: US 6,224,052 B1
(45) **Date of Patent: *May 1, 2001**

(54) SHEET-MATERIAL FEEDING DEVICE AND IMAGE FORMING APPARATUS

(75) Inventor: Toshiyuki Nagano, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/733,330

(22) Filed: Oct. 17, 1996

(30) Foreign Application Priority Data

Oct. 26, 1995 (JP) ..... 7-278678
Jul. 25, 1996 (JP) ..... 8-195910

(51) Int. Cl.[7] ..... B65H 1/08

(52) U.S. Cl. ..... 271/127; 271/110; 271/121; 271/124; 271/145; 271/258.01; 271/118

(58) Field of Search ..... 271/110, 121, 271/124, 126, 127, 147, 154, 145, 155, 156, 258.01, 273, 274, 118, 119

(56) References Cited

U.S. PATENT DOCUMENTS 5,004,218 * 4/1991 Sardano et al. ..... 271/35
5,043,770 8/1991 Nagano et al. .
5,100,122 * 3/1992 Noda et al. ..... 271/155
5,163,666 * 11/1992 Kuo ..... 271/10.03
5,201,508 * 4/1993 Kuo ..... 271/10.03
5,205,551 4/1993 Nagano et al. .
5,244,191 * 9/1993 Kanekura ..... 271/118 X
5,253,854 * 10/1993 Tanoue et al. ..... 271/118 X
5,358,230 * 10/1994 Ikemori et al. ..... 271/118 X
5,386,983 * 2/1995 Ando ..... 271/118
5,474,287 * 12/1995 Takahashi ..... 271/10.13

FOREIGN PATENT DOCUMENTS 4-333433 * 11/1992 (JP) ..... 271/118
6-156776 * 6/1994 (JP) ..... 271/273

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

A sheet-material feeding device individually separating and sequentially feeding a bundle of sheets of a sheet material mounted on a sheet-material mount. The device includes a detector for detecting the presence of the sheet material on the sheet-material mount, and a pressing member for pressing the sheet material on the sheet-material mount when the presence of the sheet material has been detected by the detetector. A sheet-mounting angle of the sheet-material mount can be changed so that an upstream portion of the bundle of sheets is lower than a portion where the sheets are separated.

36 Claims, 12 Drawing Sheets

SHEET-MATERIAL FEEDING DEVICE AND IMAGE FORMING APPARATUS

BACKGROUND OF THE INVENTION

1. Field of the Invention

This invention relates to a sheet-material feeding device used in an image forming apparatus, such as a copier, a laser-beam printer, a facsimile apparatus or the like.

2. Description of the Related Art

As shown in FIG. 11, in a conventional copier, serving as an image forming apparatus, a main body 500 of the copier is divided into a lower frame 500*a* and an upper frame 500*b*. The upper frame 500*b* is supported so as to be openable/closable relative to the lower frame 500*a*, so that the main body 500 of the copier can be widely opened for the ease of jam removing processing, maintenance and the like. An automatic original-feeding device 600 is openably/closably mounted above the main body 500 of the copier. The automatic original-feeding device 600 feeds an original S placed on platen glass 501, serving as an image reading unit, and discharges the original S after it has been read. In the automatic original-feeding device 600, when a bundle of originals S is inserted into a sheet-feeding port 601, and a copying button (not shown) on the main body 500 of the copier is depressed, a lifter 604 is raised by driving means (not shown), and the originals S are individually separated by a roller 605 and a pad 606 and are sequentially conveyed onto the platen glass 501.

In the above-described conventional apparatus, there is no holding means for immobilizing the bundle of originals S by pressing it when the bundle of originals S is inserted into the sheet-feeding port 601 of the automatic original-feeding device 600. Hence, when the main body 500 of the copier is widely opened in the above-described manner, the originals S may move in the direction of an arrow J, and in the worst case, may drop from a tray 602.

In order to prevent such phenomena, for example, a configuration in which the angle $\alpha 10$ made by the bundle of originals S set on the tray 602 and the horizontal line L is set to a large value, or a configuration in which a drop preventing wall 603 for regulating the rear end of the bundle of originals S can be considered. Such a configuration, however, results, for example, in an increase in the production cost.

SUMMARY OF THE INVENTION

The present invention has been made in consideration of the above-described problems.

It is an object of the present invention to prevent the drop of a set sheet material when opening/closing the main body of an apparatus.

According to one aspect, the present invention which achieves the above-described object relates to a sheet-material feeding device for individually separating and sequentially feeding a bundle of sheets of a sheet material mounted on a sheet-material mount, comprising detection means for detecting the presence of the sheet material on the sheet-material mount, and pressing means for pressing the sheet material on the sheet-material mount when the presence of the sheet material has been detected by the detection means. A sheet-mounting angle of the sheet-material mount can be changed so that an upstream portion of the bundle of sheets is lower than a portion where the sheets are separated.

According to another aspect, the present invention which achieves the above-described object relates to a sheet-material feeding device for individually separating and sequentially feeding a bundle of sheets of a sheet material mounted on a sheet mount, comprising a rotating member for feeding the sheet material, a rising member movable between a pressing position to grasp the bundle of sheets with the rotating member and a retracted position to release a state of grasping the bundle of sheets, and detection means for detecting a set state in which the bundle of sheets is set on the sheet mount. The rising member assumes the retracted position and the pressing position when the bundle of sheets is not in the set state, and is in the set state, respectively, based on detection information from the detection means.

According to still another aspect, the present invention which achieves the above-described object relates to an image forming apparatus comprising reading means for reading an image of an original, and the above-described sheet-material feeding device as means for feeding the original to the reading means. At least a part of a main body of the apparatus including the sheet-material feeding device is rotatable between an opened position and a closed position.

According to still another aspect, the present invention which achieves the above-described object relates to an image forming apparatus comprising image forming means for forming a recorded image on a sheet material, and the above-described sheet-material feeding device as means for feeding the sheet material to the reading means. At least a part of a main body of the apparatus including the sheet-material feeding device is rotatable between an opened position and a closed position.

According to still another aspect, the present invention which achieves the above-described object relates to a sheet-material feeding device for individually separating and sequentially feeding a bundle of sheets of a sheet material, comprising driving means which can change the direction of operation of a driving force, a rotating member for feeding the sheet material, a rising member movable between a pressing position to provide a state of grasping the bundle of sheets with the rotating member and a retracted position to release a state of grasping the bundle of sheets, and a switching mechanism, provided between the driving means and the rotating member and between the driving means and the rising member, for transmitting the driving force of the driving means to the rotating member and the rising member. The switching mechanism comprises a switching member which moves to a first position by the driving force of the driving means in one direction and to a second position by the driving force of the driving means in another direction. According to the movement to the first position, the switching member feeds a sheet from the bundle of sheets in the grasped state by transmitting the driving force to the rotating member, and moves the rising member from the pressing position to the retracted position after a predetermined time period. According to the movement to the second position, the switching member moves the rising member from the retracted position to the pressing position.

As described above, according to the present invention, when the detection means has detected that the bundle of sheets of a sheet material has been set on the sheet mount, the rising member rises to hold the sheets by grasping them with the rotating member. Hence, even if the sheet-material feeding device is inclined, the drop of the sheet material can be prevented.

The foregoing and other objects, advantages and features of the present invention will become more apparent from the following description of the preferred embodiments taken in conjunction with the accompanying drawings.

BRIEF DESCRIPTION OF THE DRAWINGS

FIG. 2(*b*) is an enlarged sectional side view of the principal portion of the sheet-material feeding device shown in FIG. 2(*a*);

DESCRIPTION OF THE PREFERRED EMBODIMENTS

A description will now be provided of sheet-material feeding devices according to preferred embodiments of the present invention. Each of the sheet-material feeding devices of the embodiments is used as a feeding device for an image forming apparatus, such as a copier, a laser-beam printer, a printer or the like, and feeds a sheet material, such as paper or the like, serving as an object for image formation, or a sheet material, such as an original or the like, serving as an object for image reading to an image forming unit or an image reading unit, respectively. Sheet-material feeding devices are grossly classified into a pawl separation type, a frictional-pad type, a retard-roller type and the like according to methods for preventing feeding of a plurality of sheets. In each of the following embodiments, a device of the frictional-pad type will be illustrated, and a copier having an automatic original-feeding device will be illustrated as an image forming apparatrus. A description will be provided of a case in which the sheet-material feeding device of the invention is used as a feeding device of the copier.

First Embodiment

Figure 1:
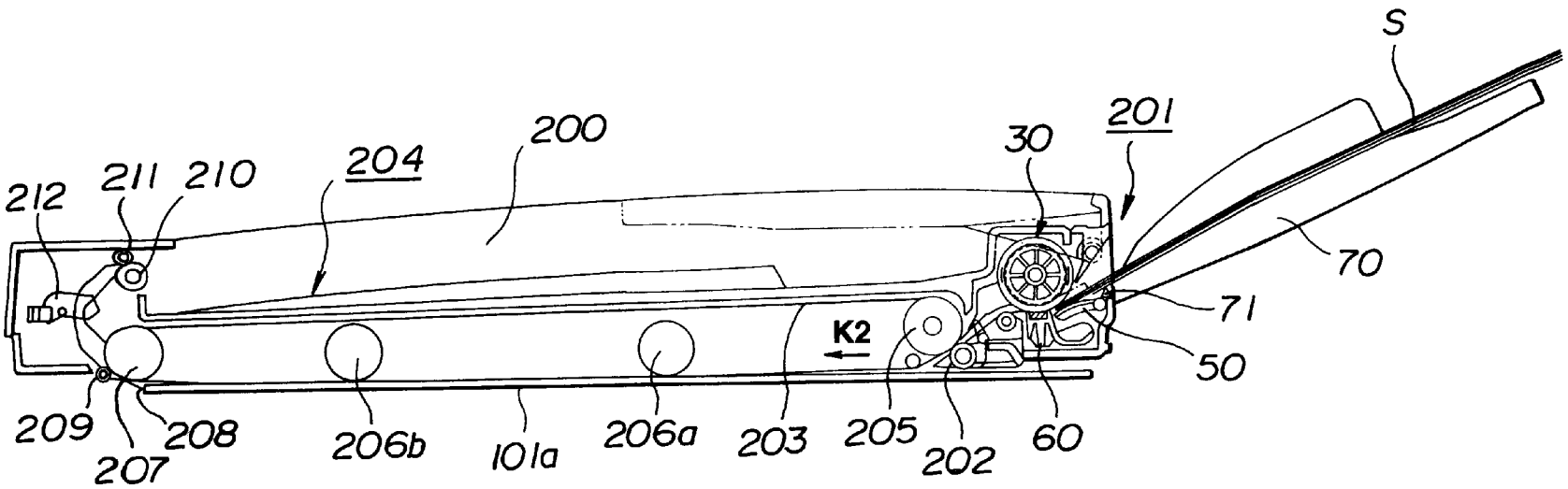
FIG. 1 is a sectional side view of an automatic original-feeding device including a sheet-material feeding device according to a first embodiment of the present invention.
Figure 2A:
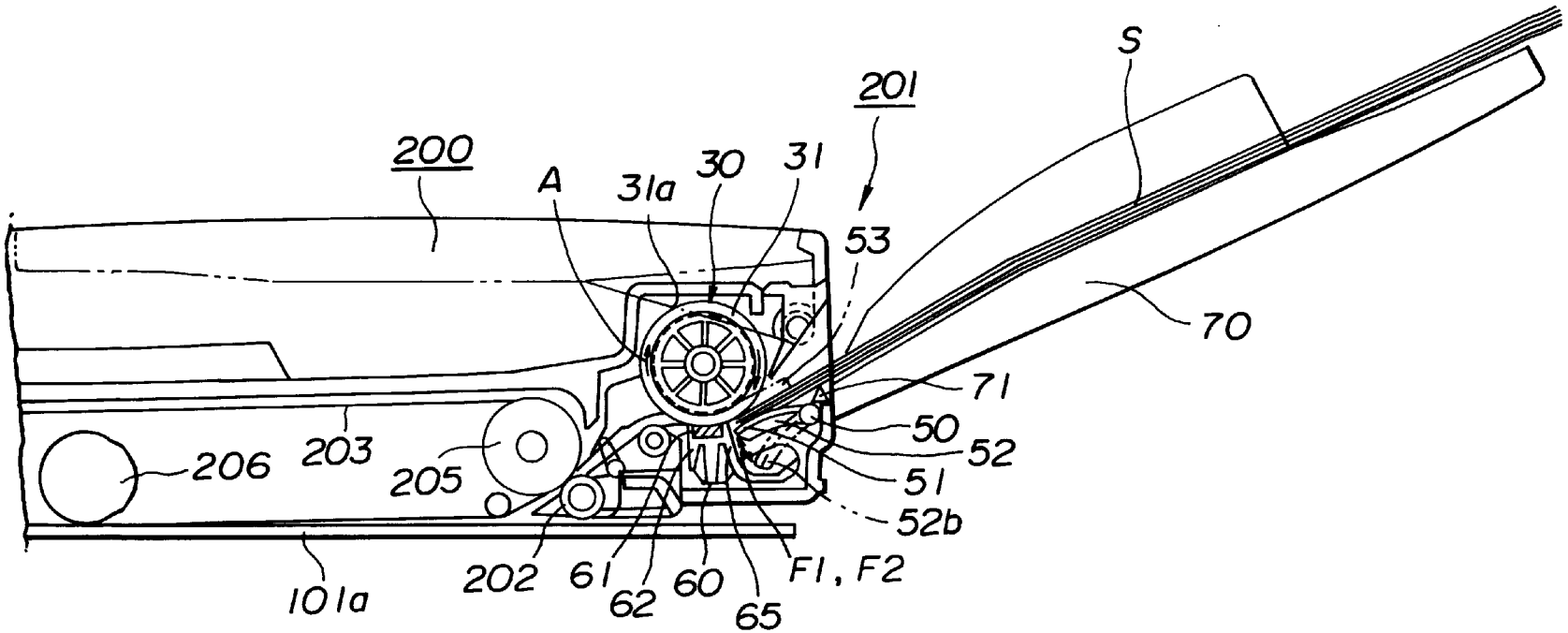
FIG. 2(*a*) is an enlarged sectional side view of the portion of the sheet-material feeding device shown in FIG. 1.
Figure 2B:
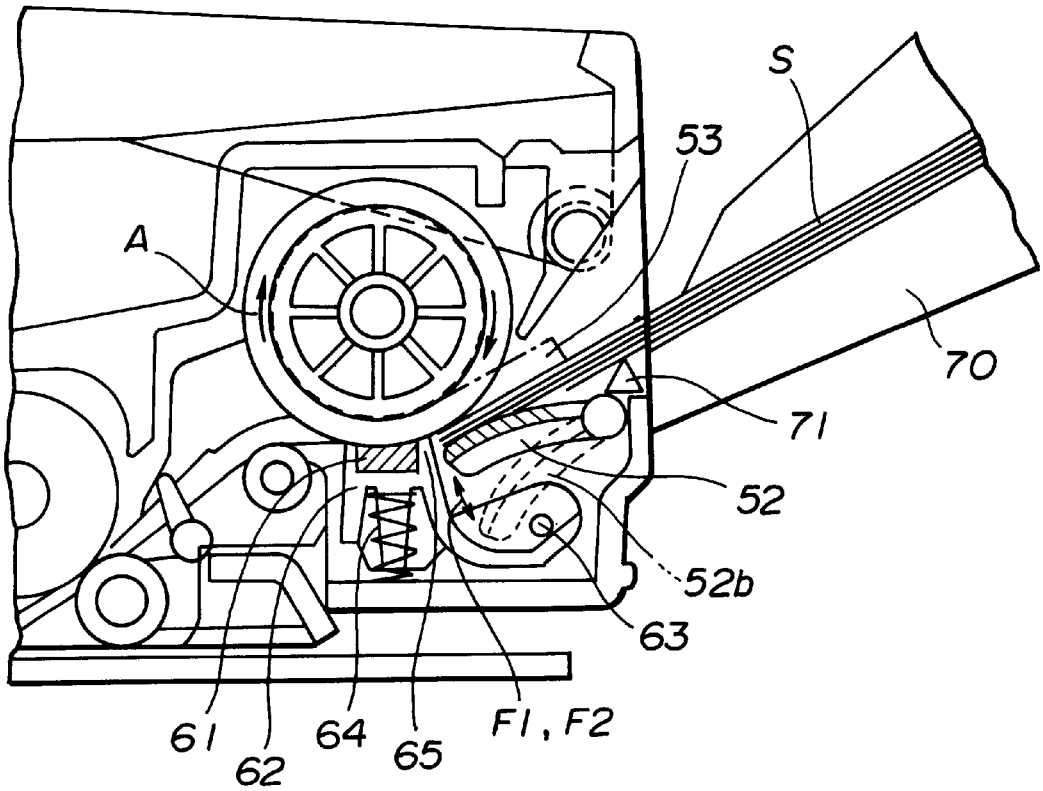
Figure 3:
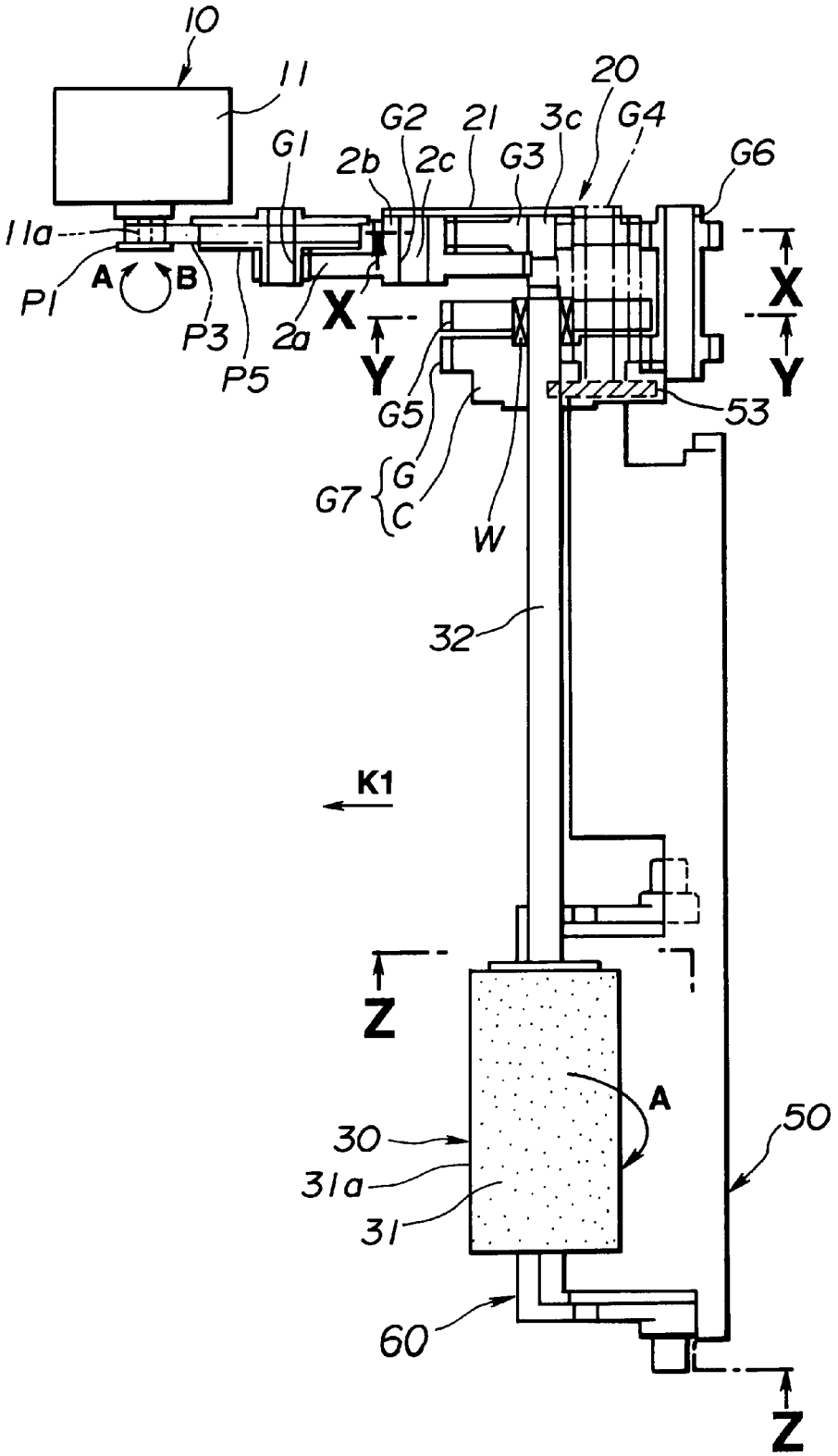
FIG. 3 is a diagram illustrating the configuration of a driving system of the sheet-material feeding device.
Figure 4A:
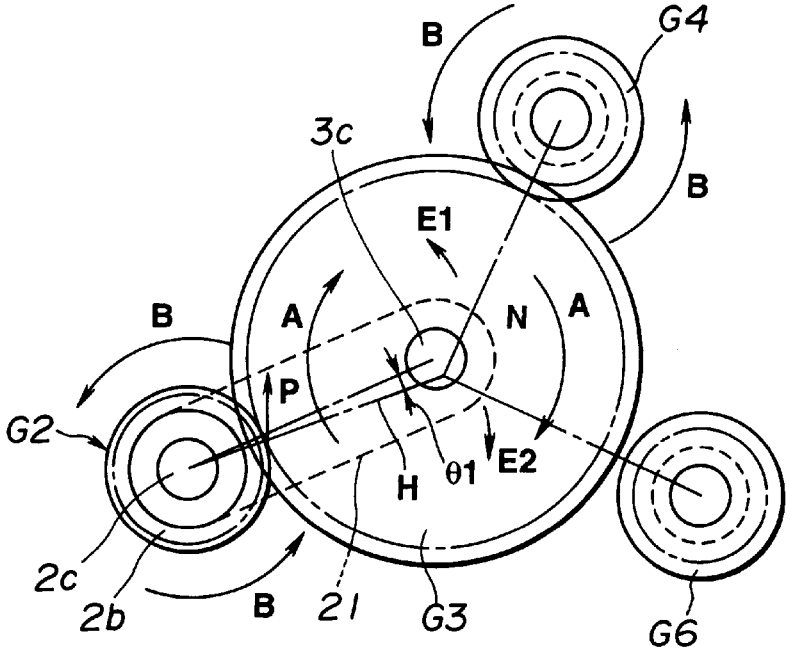
FIGS. 4(*a*) and 4(*b*) are cross-sectional views taken along line X—X and seen from the direction of arrows X shown in FIG. 3.
Figure 4B:
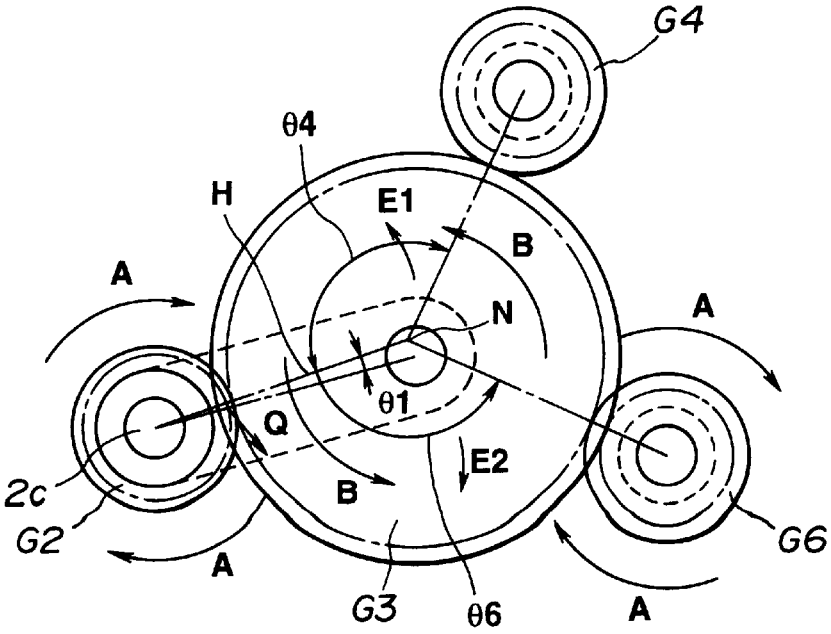
Figure 5:
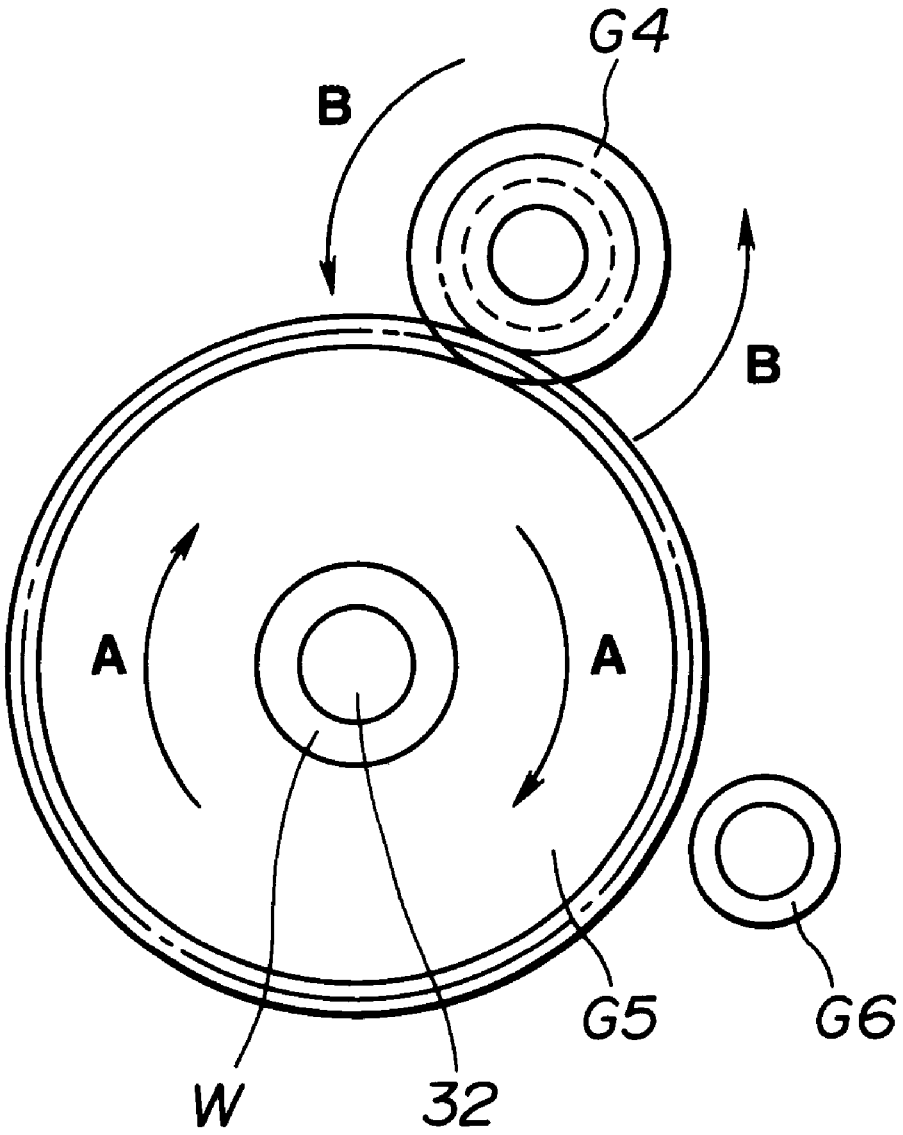
FIG. 5 is a cross-sectional view taken along line Y—Y and seen from the direction of arrows Y shown in FIG. 3.
Figure 6A:
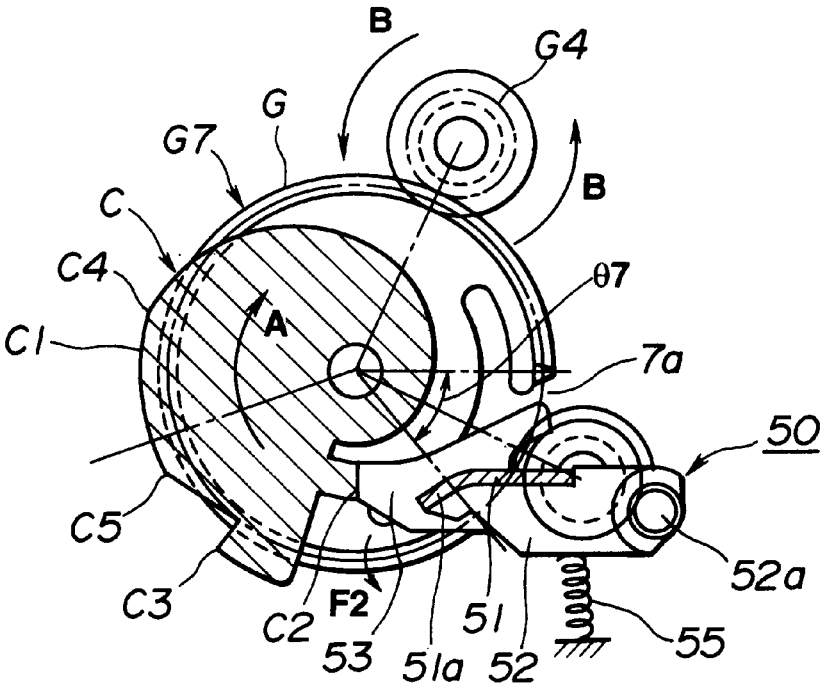
FIGS. 6(*a*) and 6(*b*) are cross-sectional views taken along line Z—Z and seen from the direction of arrows Z shown in FIG. 3.
Figure 6B:
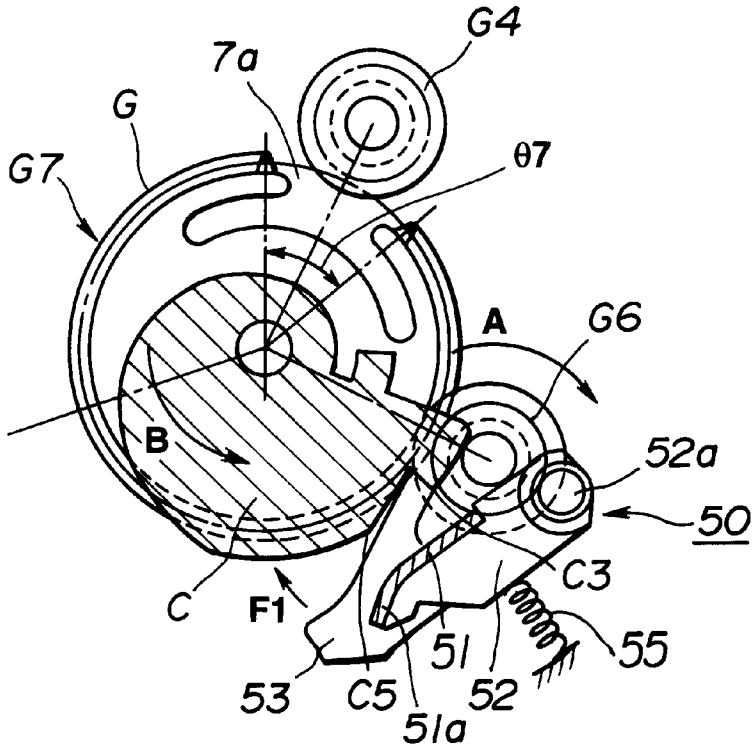
Figure 7:
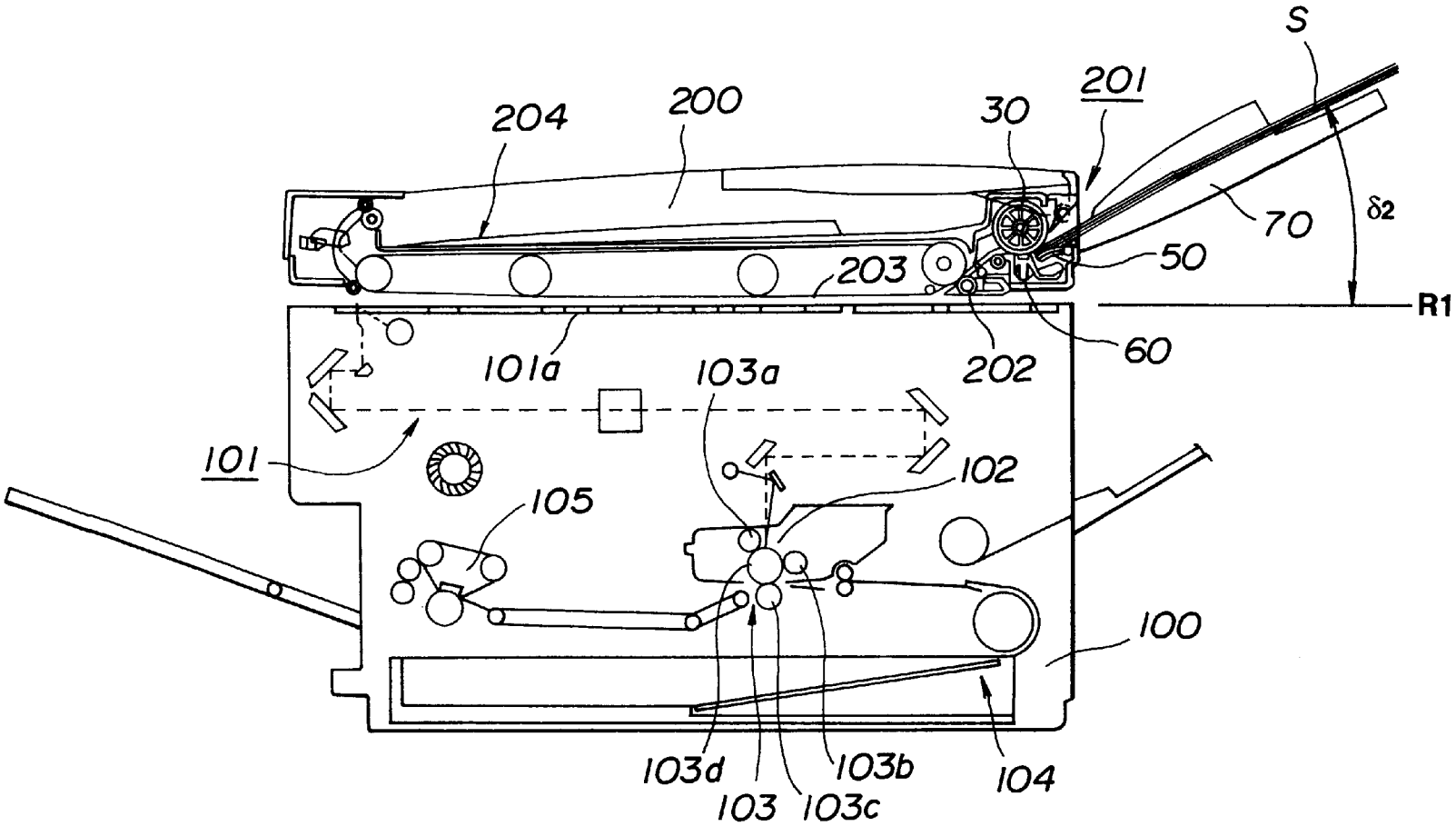
FIG. 7 is a sectional side view of an image forming apparatus in a closed state.
Figure 8:
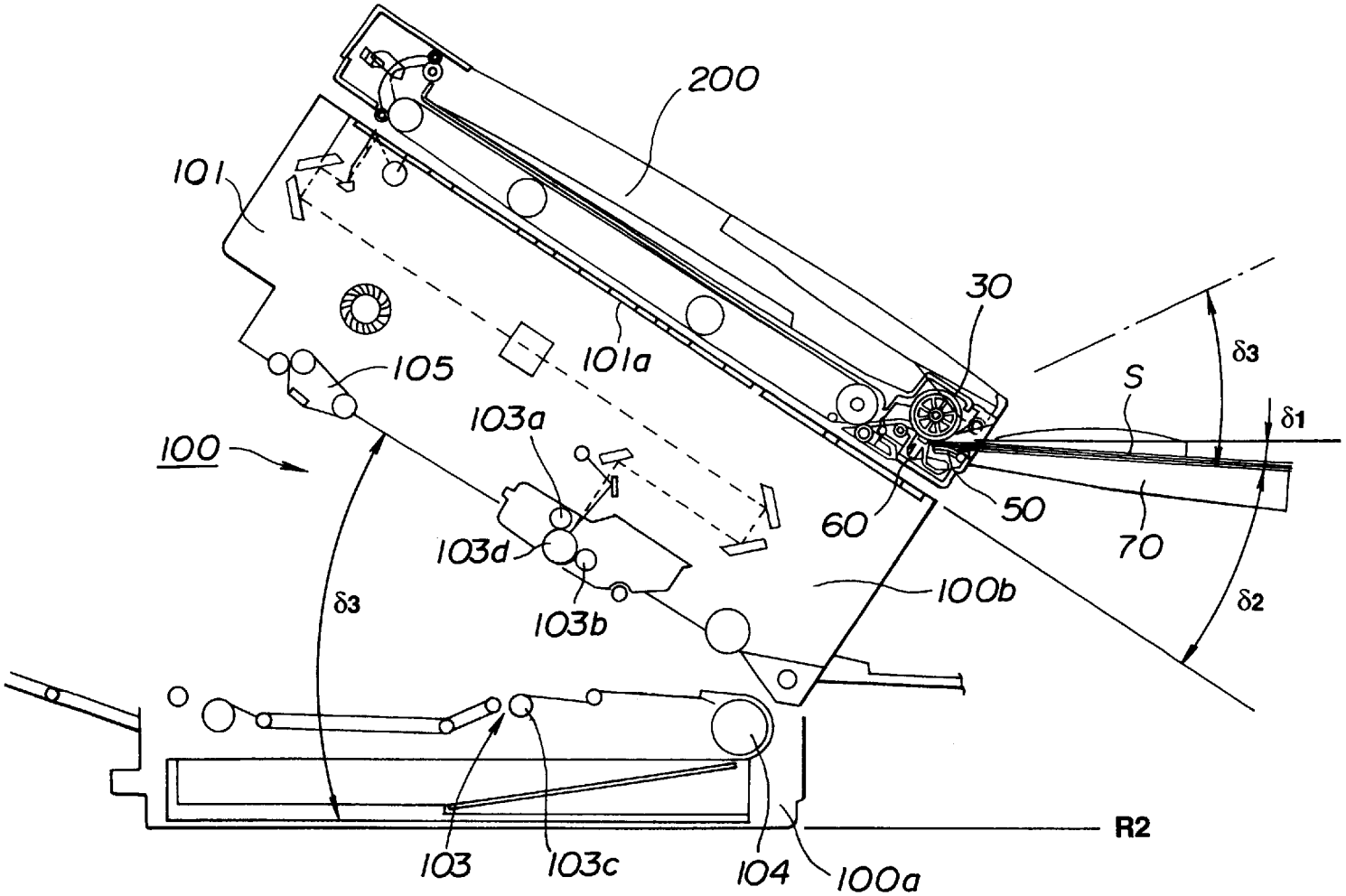
FIG. 8 is a sectional side view of the image forming apparatus in an opened state.

First, a description will be provided of a sheet-material feeding device according to a first embodiment of the present invention with reference to the drawings. FIG. 1 is a sectional side view of an automatic original-feeding device including a sheet-material feeding device according to the first embodiment. FIG. 2(*a*) is an enlarged sectional side view of the portion of the sheet-material feeding device shown in FIG. 1. FIG. 2(*b*) is an enlarged sectional side view of the principal portion of the sheet-material feeding device shown in FIG. 2(*a*). FIG. 3 is a diagram illustrating the configuration of a driving system of the sheet-material feeding device. FIGS. 4(*a*) and 4(*b*) are cross-sectional views taken along line X—X and seen from the direction of arrows X shown in FIG. 3. FIG. 5 is a cross-sectional view taken along line Y—Y and seen from the direction of arrows Y shown in FIG. 3. FIGS. 6(*a*) and 6(*b*) are cross-sectional views taken along line Z—Z and seen from the direction of arrows Z shown in FIG. 3. FIG. 7 is a sectional side view of an image forming apparatus in a closed state. FIG. 8 is a sectional side view of the image forming apparatus in an opened state.

First, a description will be provided of the outline of the sheet-material feeding device. As shown in FIG. 2(*b*) and this sheet-material feeding device includes the following principal members disposed in the direction of transmission of power from the upstream side, i.e., driving means 10, a switching mechanism 20, a feeding member 30, a rising member 50, and a separation member 60. The separation member 60 includes a frictional pad 61 and a stopper 65. The separation member 60 is pivoted on a shaft 63, and is urged in the direction of a roller 31 by a spring 64. The frictional pad 61 is set on a pad mount 62.

When feeding sheets of a sheet material, a plurality of sheets of the sheet material are laminated to provide a bundle S of the sheet material (hereinafter termed a "sheet bundle"), which is mounted on a mounting tray 70 shown in FIGS. 2(*a*), 2(*b*) and 3, and the uppermost sheet is fed in the direction of an arrow K1. At that time, a feeding roller 31 is rotatably driven in the direction of an arrow A at a predetermined timing, the rising member 50 is raised or lowered in the direction of an arrow F1 or F2 (see FIGS. 2(*a*) and 2(*b*)) at a predetermined timing, and the sheet is passed between the feeding roller 31 and the frictional pad 61. By thus performing a predetermined separation/feeding operation for the sheet material, only the uppermost sheet of the sheet material is separated from the remaining sheets and is fed to the downstream side.

Next, the state of the sheet material when it is set on the tray 70 will be described in detail (see FIGS. 2(*a*) and 2(*b*)).

When the sheet bundle S is mounted on the tray 70 and the leading edge of the sheet bundle S is inserted into a sheet feeding port, the leading edge of the sheet bundle S contacts the stopper 65 of the separation member 60. A sheet detection sensor 71, serving as detection means, detects that the sheet bundle S has been inserted into the sheet feeding port. After the detection, the driving means 10 (to be described later) operates the rising member 50, and a lifter 52 of the rising member 50 moves from a retracted position 52*b* (indicated by broken lines in FIGS. 2(*a*) and 2(*b*)) to a pressing position 52 (indicated by solid lines in FIGS. 2(*a*) and 2(*b*)). A frinctional pad 51 for generating predetermined friction $\mu$ is attached on a surface of the lifter 52 contacting the sheet. The lifter 52 is pressed against the feeding roller 31 from below by a compression spring 55, serving as pressing means, shown in FIGS. 6(*a*) and 6(*b*).

When the lifter 52 moves to the pressing position, the sheet bundle S is grasped between the feeding roller 31 and the lifter 52. The pressing force of the lifter 52 against the feeding roller 31 at that time is set to a value sufficient to convey the uppermost sheet of the sheet bundle S, and is set so that the sheet bundle S can be withdrawn if the user manually pulls another end of the sheet bundle S in a pressed state more or less strongly.

According to the above-described configuration, by only setting the sheet bundle S on the mounting tray 70, the leading edge of the sheet bundle S is grasped (gripped) by the feeding roller 31 and the lifter 52. Hence, even if the copier is opened as shown in FIG. 8, the drop of the sheet bundle S from the tray 70 can be prevented.

A description will now be provided of the driving means 10 for driving the lifter 52, the feeding roller 31 and the like with reference to FIG. 3. In the following description, the rotation of each member in the direction of an arrow A (in a clockwise direction in FIG. 3) is termed "forward rotation", and the rotation of each member in the direction of an arrow B (in a counterclockwise direction in FIG. 3) is termed "reverse rotation".

As shown in FIG. 3, a driving motor (hereinafter abbreviated as a "motor") 11 can be used as the driving means 10. It is preferable that the motor 11 can appropriately control the direction of rotation and the angle of rotation of its output shaft 11*a*. That is, the motor 11 can switch between the forward rotation in the direction of the arrow A and the reverse rotation in the direction of the arrow B, and can appropriately set the angle of rotation using a control device (not shown).

The switching mechanism 20 includes pulleys P1 and P5, a timing belt P3, gears G1–G7, and the like as main members, and performs a separation/feeding operation by the feeding member 30 and the rising member 50 (to be described later) in accordance with the forward/reverse rotation of the motor 11. As for the pulleys P1 and P5, and the gears G1–G7, components rotating in the same direction as the motor 11 are indicated by odd numbers, and components rotating in a direction opposite to the direction of rotation of the motor 11 are indicated by even numbers.

The driving pulley P1 is fixed on an output shaft 11*a* of the motor 11, and a timing belt P3 is stretched with an appropriate tension in parallel between the driving pulley P1 and the driven pulley P5 facing the driving pulley P1. Hence, when the motor 11 performs forward rotation in the direction of the arrow A, the driving pulley P1, the timing belt P3 and the driven pulley P5 perform forward rotation.

The driving gear G1 is integrated with the driven pulley P5, and therefore performs forward rotation in accordance with the forward rotation of the driven pulley P5.

The stepped gear G2 has a large-diameter gear portion 2*a* meshing with the driving gear G1, and a small-diamter gear portion 2*b* meshing with the switching gear G3 (to be described later), and rotates in the direction of an arrow B shown in FIG. 4(*a*) in accordance with the forward rotation of the driving gear G1.

The switching gear G3, serving as a switching member, is disposed so as to perform revolution around the stepped gear G2. While the axis 2*c* of the stepped gear G2 is fixed, the axis 3*c* of the switching gear G3 is movably disposed. The axes of other gears than the switching gear G3 from among the gears G1–G7 are fixed. The axis 2*c* of the stepped gear G2 and and the axis 3*c* of the switching gear G3 are connected to each other by a connecting arm 21 having the shape of a long plate (indicated by solid lines in FIG. 3, and indicated by broken lines in FIGS. 4(*a*) and 4(*b*)). The distance between the axes 3*c* and 2*c* is maintained constant by this connecting arm 21, and the switching gear G3 can perform circular motion around the stepped gear G2. Accordingly, the entire switching gear G3 held on the axis 3*c* can perform revolution around the stepped gear G2 (more precisely, around the small-diameter gear portion 2*b*). When the motor 11 stops, the stepped gear G2 stops, and the switching gear G3 meshing with the stepped gear G2 also stops. If the position N of the center of the axis 3*c* of the switching gear G3 in this stopped state is determined as a neutral position, and the straight line connecting this neutral position N and the center of the axis 2*c* of the stepped gear G2 is determined as a reference line H, the revolution of the switching gear G3 with respect to the stepped gear G2 is performed within the range of an angle θ1 in the directions of arrows E1 and E2 shown in FIGS. 4(*a*) and 4(*b*), resulting in a swinging motion. The positions when the switching gear G3 moves by the angle θ1 in the direction of the arrow E1 and in the direction of the arrow E2 with respect to the reference line H are termed a first position (FIG. 4(*a*)) and a second position (FIG. 4(*b*)). The value of the angle θ1 will be described later.

The movement of the switching gear G3 to the first position and the second position is performed by the reverse rotation and the forward rotation of the stepped gear G2 (accordingly, the forward rotation and the reverse rotation of the motor 11), respectively. A description will now be provided of these operations.

When the motor 11 performs forward rotation, and as shown in FIG. 4(*a*), the stepped gear G2 performs reverse rotation in the direction of the arrow B, a force P operates from the stepped gear G2 to the switching gear G3 in the direction of the pressure angle of the teeth portion of the stepped gear G2 at the contact portion between the stepped gear G2 and the switching gear G3. The switching gear G3 performs forward rotation in the direction of the arrow A by this force P. At that same time, a force in the direction of the arrow E1 operates on the axis 3*c*. The switching gear G3 thereby moves in the direction of the arrow E1 by the angle θ1 to reach the first position while performing forward rotation in the direction of the arrow A. The switching gear G3 remains at the first position and continues forward rotation in the direction of the arrow A as long as the motor 11 peforms forward rotation and the force P is transmitted via the stepped gear G2.

When the motor 11 performs reverse rotation, and, as shown in FIG. 4(*b*), the stepped gear G2 performs forward rotation in the direction of the arrow A, the switching gear G3 moves to the second position. That is, in this case, by a force Q operating from the stepped gear G2 to the switching gear G3, the switching gear G3 moves in the direction of the arrow E2 by the angle θ1 to reach the second position while performing reverse rotation in the direction of the arrow B. The switching gear G3 remains at the second position and continues reverse rotation in the direction of the arrow B as long as the motor 11 performs reverse rotation and the force P is transmitted via the stepped gear G2.

As described above, the switching gear G3 performs forward rotation and reverse rotation in accordance with the foward rotation and the reverse rotation of the motor 11, respectively. In addition, the switching gear G3 automatically assumes the first position and the second position in accordance with the forward rotation and the reverse rotation of the motor 11, respectively. The relationship between the forward rotation and the reverse rotation of the motor 11, and the first position and the second position of the switching gear G3 may, of course, be set opposite to the above-described relationship. However, for the convenience of description, the above-described relationship will be adopted in the following description.

An upper idler gear (first idler gear) G4 and a lower idler gear (second idler gear) G6 are disposed around the switching gear G3. As shown in FIG. 4(*b*), the upper idler gear G4 and the lower idler gear G6 are disposed at a position obtained by rotating in a clockwise direction by an angle θ4 from the reference line H and at a position obtained by rotating in a counterclockwise direction by an angle θ6 from the reference line H, respectively. These angles θ4 and θ6 and the above-described angle θ1 are set so as to satisfy the following conditions (1)–(3).

(1) When the switching gear G3 is at the neutral position N, it slightly meshes with both of the upper idler gear G4 and the lower idler gear G6.

(2) When the switching gear G3 is at the first position shown in FIG. 4(*a*), it completely meshes with the upper idler gear G4, and the mesh with the lower idler gear G6 is released.

(3) When the switching gear G3 is at the second position shown in FIG. 4(*b*), it completely meshes with the lower idler gear G6, and the mesh with the upper idler gear G4 is released.

In the above-described case (2), since the switching gear G3 performs forward rotation in the direction of the arrow A, the upper idler gear G4 performs reverse rotation in the direction of the arrow B. On the other hand, in the above-described case (3), since the switching gear G3 performs reverse rotation in the direction of the arrow B, the lower idler gear G6 performs forward rotation in the direction of the arrow A.

As shown in FIGS. 3 and 5 (taken along line Y—Y and seen from the direction of the arrows Y), the feeding gear G5 meshes with an intermediate portion of the upper idler gear G4 in the axial direction. When the upper idler gear G4 performs reverse rotation in the direction of the arrow B, the feeding gear G5 performs forward rotation in the direction of the arrow A. As will be described later, according to this forward rotation, the feeding roller 31 can feed the sheet by performing forward rotation in the direction of the arrow A.

As shown in FIG. 3, and FIGS. 6(*a*) and 6(*b*) (taken along line Z—Z and seen from the direction of the arrows Z shown in FIG. 3), the cam gear G7 is configured so as to mesh with both of the upper idler gear G4 and the lower idler gear G6. This is because both of the forward rotation and the reverse rotation of the cam gear G7 are required in order to raise and lower the rising member 50 (to be described later). That is, by utilizing the reverse rotation of only the upper idler gear G4 and the forward rotation of only the lower idler gear G7; and the cam gear G6 performs forward rotation and reverse rotation, respectively. The cam gear G7 will now be described in detail.

A gear portion G and a cam portion C are formed at different positions of the cam gear G7 in the axial direction. The gear portion G has a toothless region 7*a* at a part thereof in the circumferential direction. This toothless region 7*a* is formed within the range of an angle θ7 so that, when the center of the toothless region 7*a* reaches a position corresponding to the center of the upper idler gear G4 or the lower idler gear G6 by the rotation of the cam gear G7, the rotation of the upper idler gear G4 or the lower idler gear G6 is not transmitted to the cam gear G7. A cam surface C1 is formed on the cam portion C in the circumferential direction. Stoppers C2 and C3 are provided at a starting end portion and at a terminating end portion of the cam surface C1, respectively, and steps C4 and C5 are formed at intermediate portions of the cam surface C1. The cam portion C contacts and leaves a cam follower 53 (to be described later) provided at one end of the rising member 50 to raise and lower the entire rising member 50, respectively.

The entire cam gear G7 performs forward rotation in the direction of the arrow A in accordance with the reverse rotation of the upper idler gear G4 caused by the forward rotation of the motor 11 (see FIG. 6(*a*)), and performs reverse rotation in the direction of the arrow B in accordance with the forward rotation of the lower idler gear G6 caused by the reverse rotation of the motor 11 (see FIG. 6(*b*)). In accordance with the forward rotation and the reverse rotation of the entire cam gear G7, the entire rising member 50 is raised and lowered, respectively. This operation will be described in detail later.

As shown in FIG. 3, the feeding member 30 includes the feeding roller 31, a rotation shaft 32 and a one-way clutch W. The feeding roller 31 comprises a roller-shaped member having appropriate elasticity, and has a feeding surface 31*a*. The feeding roller 31 is connected to the above-described feeding gear G5 via the rotation shaft 32. The one way clutch W is disposed between the rotation shaft 32 and the feeding gear G5. The one-way clutch W is locked when the feeding gear G5 performs forward rotation in the direction of the arrow A and the driving force in that direction operates from the feeding gear G5 onto the rotation shaft 32. At that time, the driving force in the direction of the arrow A is transmitted to the feeding roller 31. On the other hand, the one-way clutch W is released when the driving force of the feeding roller 31 in the direction of the arrow A is to be transmitted to the feeding roller 31. Accordingly, as will be described later, when the driving force has been transmitted from the sheet material to the feeding roller 31, the feeding roller 31 slips.

As shown in FIGS. 2(*a*) and 2(*b*), the rising member 50 includes the lifter 52, the frictional pad 51 and the cam follower 53 (indicated by broken lines in FIGS. 2(*a*) and 2(*b*)). The lifter 52 is formed in the shape of a plate which is long in a direction orthogonal to the sheet-material conveying direction (the direction of the arrow K1) (FIG. 3). The base end (the right side in FIGS. 6(*a*) and 6(*b*)) of the lifter 52 is swingably supported by a shaft 52*a*, so that the distal end of the lifter 52 can be raised and lowered in the directions of arrows F1 and F2, respectively. The frictional pad 51 is attached on the upper surface of the distal end of the lifter 52 (the contact surface with the sheet material). As shown in FIGS. 6(*a*) and 6(*b*), the frictional pad 51 has a grasping portion 51*a*, which is gently inclined downward, at a distal end portion. The cam follower 53 contacting and leaving the cam portion C of the cam gear G7 is mounted on a right end portion of the lifter 52. The lifter 52, the frictional pad 51 and the cam follower 53 are configured as one body, and therefore are raised and lowered as one body. The compression spring 55, serving as pressing means, is disposed under the rising member 50. Thus, the distal end portion of the rising member 50 is urged toward the cam gear G7 (or the feeding roller 31) present above the rising member 50.

Next, a description will be provided of the rising/descending operation of the rising member 50. As shown in FIG. 6(*a*), the descent of the rising member 50 is performed by the reversal rotation of the upper idler gear G4 in the direction of the arrow B from the state of FIG. 6(*a*). On the other hand, as shown in FIG. 6(*b*), the rise of the rising member 50 is performed by the forward rotation of the lower idler gear G6 in the direction of the arrow A from the state of FIG. 6(*b*).

When the upper idler gear G4 performs reverse rotation in the direction of the arrow B, the cam gear G7 performs forward rotation in the direction of the arrow A. When the cam gear G7 continues the forward rotation, the cam follower 53 of the rising member 50 is gradually lowered by the cam surface C1 of the cam portion C against the urging force of the compression spring 55. While the portion between the steps C4 and C5 of the cam surface C1 is contacting the cam follower 53, the cam follower 53 is lowered to the lowest position. As shown in FIG. 6(*b*), when the step C5 has passed through the cam follower 53 and the stopper C3 at the terminating end side contacts the cam follower 53, the cam gear G7 stops. The position of the rising member 50 at that time is determined as the retracted position. At that time, since the toothless region 7*a* of the cam gear G7 faces the upper idler gear G4, the driving force from the upper idler gear G4 is no longer transmitted to the cam gear G7.

When, as shown in FIG. 6(*b*), the lower idler gear G6 performs forward rotation in the direction of the arrow A, the cam gear G7 performs reverse; rotation in the direction of the arrow B, and the rising member 50 rises in a direction opposite to the direction of the above-described case of descent. As shown in FIG. 6(*a*), the cam gear G7 stops when the stopper C2 at the starting end side contacts the cam follower 53. The position of the rising member 50 at that time is determined as the pressing position. At that time, since the toothless region 7*a* of the cam gear G7 faces the lower idler gear G6, the driving force from the lower idler gear G6 is no longer transmitted to the cam gear G7.

As will be described later, the above-described rising/descending operation of the rising member 50 is performed in accordance with the swinging operation (the movement between the first position and the second position) of the switching gear G3 caused by the forward rotation and the reverse rotation of the motor 11.

As shown in FIGS. 2(*a*) and 2(*b*), the separation member 60 includes the frictional pad 61 and the pad mount 62. The frictional pad 61 is bonded on the upper surface of the pad mount 62, and is made in gentle contact with the feeding surface 31*a* of the feeding roller 31 by the spring 64. The frictional pad 61 prevents feeding of a plurality of sheets of the sheet material passing between the frictional pad 61 and the feeding roller 31 by utilizing the frictional force.

The coefficients of friction between respective components will now be briefly described.

If the coefficients of friction between the feeding roller 31 and the sheet material, between the sheet material and the frictional pad 51, between the sheet material and the frictional pad 61, and between sheets of the sheet material are represented by $\mu 1$, $\mu 2$, $\mu 3$ and $\mu 4$, respectively, the materials of the respective components are selected so as to satisfy the following relationships:

$$\mu 1 > \mu 2, \text{ and } \mu 3 > \mu 4.$$

By setting such relationships, feeding of a plurality of sheets of the sheet material is prevented, so that sheets can be assuredly separated and fed.

In FIG. 2(*a*), a conveying roller 202 is disposed at a downstream portion of the sheet-material feeding device. The conveying roller 202 further conveys the sheet of the sheet material separated and fed by the sheet-material feeding device to the downstream side. After the leading edge of the sheet has reached the conveying roller 202, the conveying force for the sheet is provided by the conveying roller 202. At that time, if a trailing edge portion of the sheet is grasped between the feeding roller 31 and the rising member 50 present at the pressing position, a failure in conveyance, or the like may occur. Hence, the rising member 50 is lowered in the direction of the arrow F2 in the above-described manner (see FIG. 6(*b*)).

Next, a description will be provided of the operation of the entire sheet-material feeding device.

When a bundle of sheets of the sheet material is not mounted on the mounting tray 70, the absence of the sheet material is detected by a sensor 71 (see FIGS. 2(*a*) and 2(*b*)), and the rising member 50 is lowered to the retracted position indicated in FIG. 6(*b*).

A plurality of sheets of the sheet material are mounted on the mounting tray 70 as the sheet bundle S. The distal end of the sheet bundle S is inserted between the feeding roller 31 and the rising member 50, and the sheet bundle S is positioned by making the leading edge thereof in contact with a portion 65 of the separation member 60. The sensor 71 detects the presence of the sheet bundle S when it has been mounted, and the rising member 50 is raised to the pressing position shown in FIG. 6(*a*) by rotating the gear G7 in the direction of the arrow B. Thus, the leading edge of the sheet bundle S is grasped between the feeding roller 31 and the rising member 50, and preparation for the feeding of the sheet material is completed.

By making the sheet bundle S in contact with the feeding surface 31*a* of the feeding roller 31 by raising the rising member 50 to the pressing position, two functions, i.e., a function of picking up the sheet bundle S, and a function of preventing the sheet bundle S from dropping, are provided.

If only the function of picking up the rising member 50 is required, the detection sensor 71 is unnecessary. After setting the sheet material on the tray 70, the rising member 50 may be raised by depressing a copying start button. However, if the copier is opened as shown in FIG. 8 before depressing the copying start button after setting the sheet bundle S, the sheet bundle S set on the tray 70 may drop in this configuration.

Accordingly, in the present embodiment, the detection sensor 71 is provided in order to prevent the sheet bundle S mounted on the tray 70 from dropping even in the above-described case, so that the sheet bundle S is held immediately after it has been set.

Furthermore, in the separation sequence, the rising member 50 is raised to the pressing position immediately after it has descended to the retracted position, so that the time period during which the sheet bundle S is not held is minimized (the details will be described later). When electric power supply is disconnected due to jam removal processing or the like, the rising member 50 is always raised to the pressing position before the disconnection to hold the sheet bundle S. Thus, in addition to the operation of individually picking up sheets of the sheet bundle S, the sheet bundle S can be held (prevention of the drop of the sheet bundle S).

When preparation for feeding of the sheet material has been completed in the above-described manner and the copying start button has been depressed, the motor 11 performs forward rotation in the direction of the arrow A. Alternatively, the feeding of the sheet material may be automatically started after a predetermined time period when the sensor 71 has detected the presence of the sheet material. According to this forward rotation, the driving pulley P1, the timing belt P3, the driven pulley P5 and the driving gear G1 perform forward rotation, and the stepped gear G2 performs reverse rotation. The switching gear G3 thereby moves to the direction of the arrow El to assume the first position while performing forward rotation. The upper idler gear G4 thereby performs reverse rotation in the direction of the arrow B. As shown in FIG. 5, the feeding gear G5 thereby performs forward rotation in the direction of the arrow A, and as shown in FIG. 6(*a*), the cam gear G7 also performs forward rotation in the direction of the arrow A. According to the forward rotation of the feeding gear G5, the feeding roller 31 performs forward rotation in the direction of the arrow A to feed the uppermost sheet of the sheet bundle S. On the other hand, when the cam gear G7 slightly rotates, the cam surface C1 of the cam portion C starts contacting the cam follower 53 of the rising member 50, which is pressed downward. The cam gear G7 continues its rotation until the stopper C3 provided at the terminating end side contacts the cam follower 53 from the upstream side as shown in FIG. 6(*b*), and the transmission of the driving force is interrupted when the toothless region 7*a* faces the upper idler gear G4. The feeding of the sheet material by the feeding roller 31 is continued until the leading edge of the sheet material reaches the conveying roller 202. By passing between the feeding roller 31 and the frictional pad 61 of the separation member 60, only one sheet of the sheet material is fed by being separated from the succeeding sheet. The conveying roller 202 provides a conveying force for the sheet which has reached the conveying roller 202. The descent of the rising member 50 is started immediately after the start of sheet conveyance by the conveying roller 202. Thereafter, the sheet is drawn from between the feeding roller 31 and the frictional pad 61 by being pulled by the conveying roller 202. At that time, although the feeding roller 31 is driven by the sheet, it slips by the above-described function of the one-way clutch W.

After the separating/feeding operation of the sheet material has been completed, when the motor 11 performs reverse rotation in the direction of the arrow B, the stepped gear G2 performs forward rotation in the direction of the arrow A as shown in FIG. 4(*b*). The switching gear G3 performs reverse rotation in the direction of the arrow B, and moves in the direction of the arrow E2 to assume the second position. The lower idler gear G6 thereby performs forward rotation in the direction of the arrow A, and the cam gear G7 performs reverse rotation in the direction of the arrow B. The cam follower 53 moves along the cam surface C1 of the cam portion C, and the entire rising member 50 rises. This reverse rotation of the cam gear G7 continues until the stopper C2 provided at the starting end side contacts the cam follower 53 from the upstream side, as shown in FIG. 6(*a*). When the toothless region 7*a* faces the lower idler gear G6, the transmission of the driving force is interrupted. Thus, the rising member 50 returns to the pressing position before feeding the sheet material, and grasps the leading edge of the sheet bundle S after the uppermost sheet has been fed with the feeding roller 31.

By repeating the forward rotation in the direction of the arrow A and the reverse rotation in the direction of the arrow B of the motor 11, sheets of the sheet material can be individually separated and fed.

Next, a copier, serving as an image forming apparatus including the sheet-material feeding device of the present embodiment., will be briefly described with reference to FIGS. 1, 7 and 8. The copier shown in FIGS. 7 and 8 comprises a main body 100 of the copier, and an automatic original-feeding device 200 mounted on the upper surface of the main body 100.

The main body 100 of the copier includes a reading unit 101 for reading an image of an original mounted on platen glass 101*a,* an exposure unit 102 for outputting a signal in accordance with the result of reading, an image forming unit 103 for forming a toner image on a sheet material, such as paper or the like, using a charger 103*a,* a developing unit 103*b,* a transfer unit 103*c,* a photosensitive drum 103*d* and the like, conveying means 104 comprising a plurality of pairs of rollers, and the like for feeding the sheet material to the image forming unit 103 and conveying the sheet material after toner image formation, and a fixing unit 105 for fixing the unfixed toner image on the sheet material using heat and pressure.

The automatic original-feeding device 200 is disposed on the platen glass 101*a,* and includes the above-described sheet-material feeding device 201, a conveying roller 202 for conveying the fed sheet material, a conveying belt 203 which is moved in the direction of the arrow K2 by a driving roller 205, driven rollers 206*a* and 206*b,* and a tension roller 207, a discharging tray 204, a guide 208, discharging rollers 209, 210 and 211, and a sheet-material detection sensor 212 (see FIG. 1). The sheet material, serving as the original, separated and fed by the sheet-material feeding device 201, is conveyed toward the platen glass 101*a* by the conveying roller 202, and is set onto a predetermined position on the platen glass 101*a* by the conveying belt 203. After the image of the original has been read, the sheet material is again conveyed by the conveying belt 203, and is discharged onto the discharging tray 204 by the pair of discharging rollers 210 and 211, and the like.

The main body 100 of the copier comprises a lower frame 100*a* and an upper frame 100*b*. As shown in FIGS. 7 and 8, the upper frame 100*b* is rotatable between a closed position and an opened position relative to the lower frame 100*a*. According to this configuration, for example, during jam removal processing or when exchanging a cartridge, the upper frame 100*b* of the main body 100 of the copier can be moved to the opened position to open the inside of the copier, as shown in FIG. 8. When the main body 100 of the copier is opened, if the rear end of the original set on the tray 70 of the automatic original-feeding device 200 is positioned lower than the horizontal line R1, i.e., if the tray 70 is inclined downward from the horizontal line R1 (with an angle δ1 shown in FIG. 8), the sheet bundle (original-bundle) S may drop from the tray 70. In the present embodiment, however, since the above-described rising member 50 rises to the pressing position to grasp the sheet bundle S with the feeding surface 31*a* of the feeding roller 31, the drop of the sheet bundle S from the tray 70 can be prevented.

As described above, the rising member 50 repeats the rising/descending operation. The present embodiment provides a sequence in which the time period of the rise is longer while the bundle of originals, serving as the sheet material, remains on the tray 70. The embodiment also provides a sequence in which the rising member 50 always stops in a rising state when a sheet jam or the time for cartridge exchange is detected. In addition, even if electric power supply is interrupted, the pressing state of the rising member 50 is maintained by the compression spring 55, serving as pressing means. Accordingly, the device of the present embodiment is very reliable.

A description will now be provided of the angle made by the mounting surface R1 of the apparatus and the mounting surface of the tray 70 when the main body 100 of the copier is opened/closed. If the angle made by the mounting surface R1 of the copier and the mounting surface of the tray 70 in a closed state of the main body 100 of the copier is represented by δ2 as shown in FIG. 7, and the amount of movement (the angle) of the mounting surface of the tray 70 when the upper frame 100*b* of the main body 100 of the copier is rotated from the closed position to the opened position is represented by δ3 as shown in FIG. 8, the above-described angle δ1 has the following relationship with these angles:

$\delta 1 = \delta 3 - \delta 2$.

The angle δ3 in the closed state is preferably larger from the viewpoint of operability during operations, such as jam removal processing, exchange of the cartridge, and the like, and the angle δ2 cannot be too large in consideration of influence on the property of separating the sheet material. Accordingly, many copiers have the above-described relationship (i.e., the mounting surface of the tray 70 is positioned downward from the horizontal line R1 in the opened state). Hence, it is effective to apply the present invention to these apparatuses, and the invention can greatly contribute to prevention of the drop of the sheet material.

Other Embodiments

In the first embodiment, the case of applying the present invention to the sheet-material feeding device for individually separating originals, serving as sheets of a sheet material, and feeding each of the separated originals to the image reading unit 101 has been illustrated. However, the present invention is not limited to such a case. For example, as shown in FIGS. 9 and 10, the present invention may also be applied to a multisheet feeding device 300 for individually separating and feeding sheets of paper or the like, serving as sheets of a sheet material, to an image forming unit.

Figure 9:
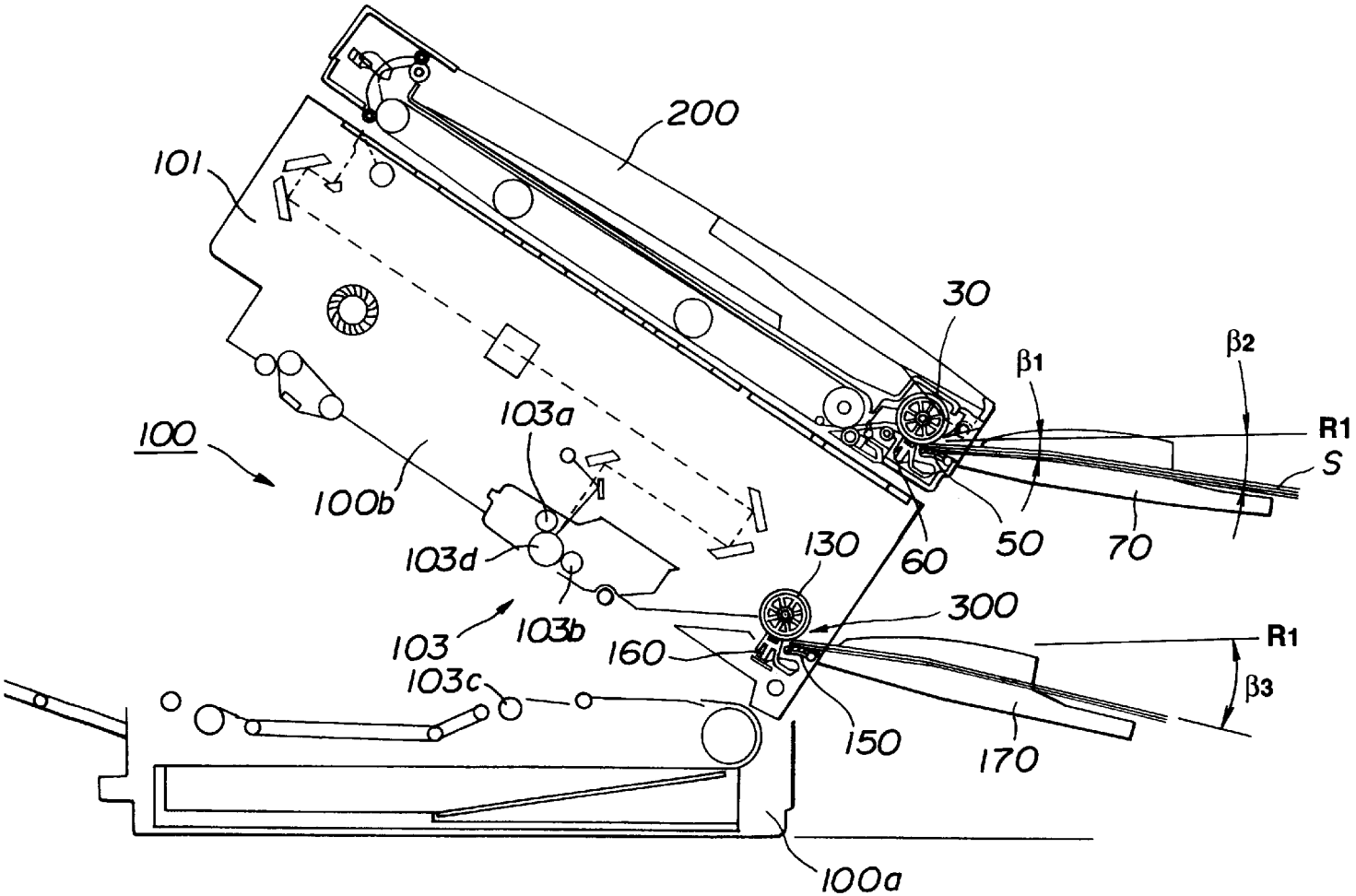
FIG. 9 is a sectional side view illustrating a sheet-material feeding device according to another embodiment of the present invention.

In a copier shown in FIG. 9, a tray 70 of an automatic original-feeding device 200 has two steps of inclination with angles β1 and β2 made by the horizontal line R1 and a sheet bundle S on the tray 70 in a closed state. The angle made by a sheet bundle S on a tray 170 of the multisheet feeding device 300 provided on an upper frame 100*b* of a main body 100 of the copier and the horizontal line R1 is represented by β3. That is, with the above described angles β1, β2 and β3, the rear end of the sheet bundle S is positioned downward from the horizontal line R1 in a closed state. In FIG. 9, there are also shown a feeding member 130, a rising member 150 and a separation member 160, which are the same as the feeding member 30, the rising member 50 and the separation member 60 in the first embodiment, respectively. Accordingly, by applying the present invention to the sheet-material feeding device of the copier shown in FIG. 9, the drop of the sheet bundle on the tray can be prevented.

Figure 10:
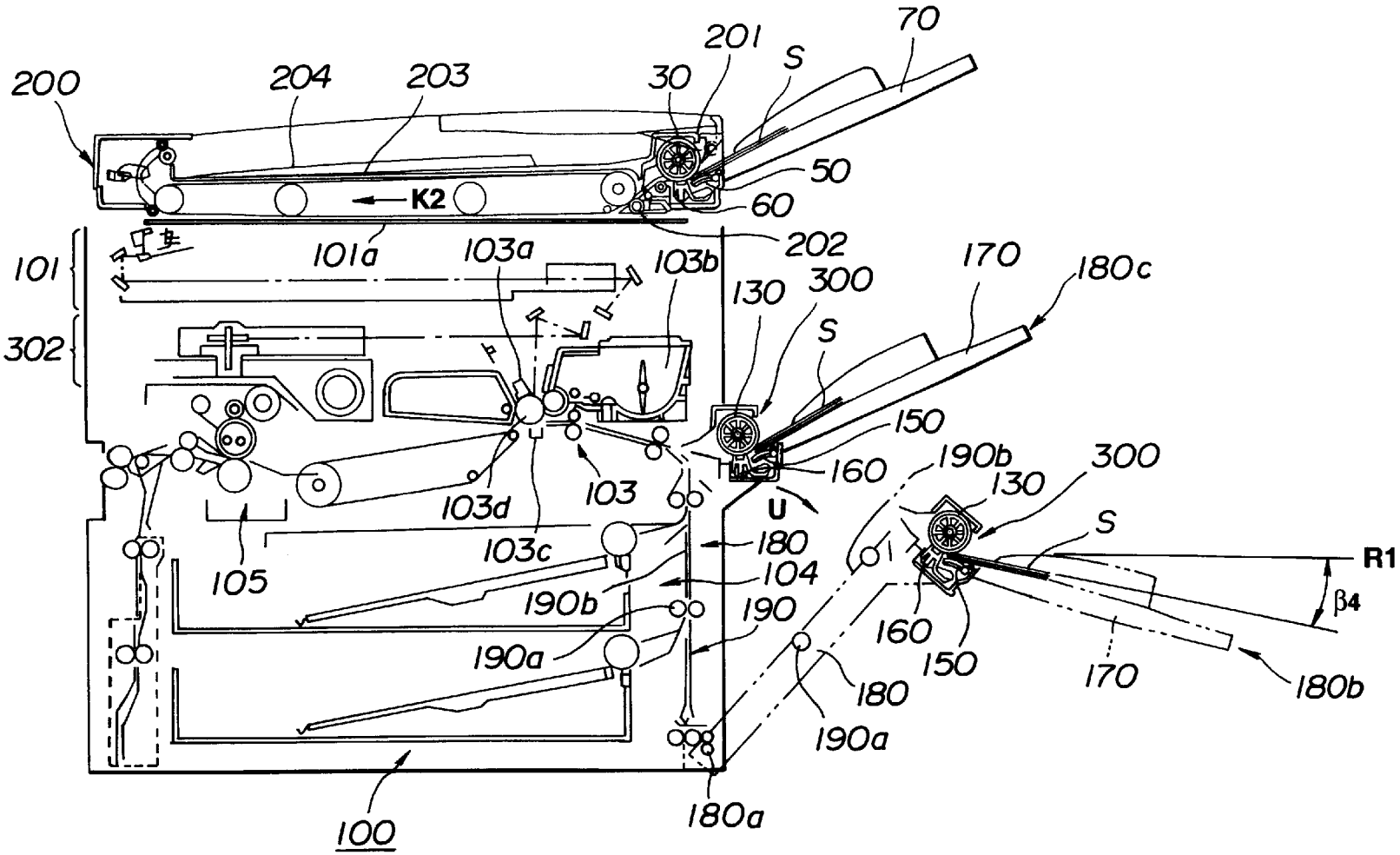
FIG. 10 is a sectional side view illustrating a sheet-material feeding device according to still another embodiment of the present invention.
Figure 11:
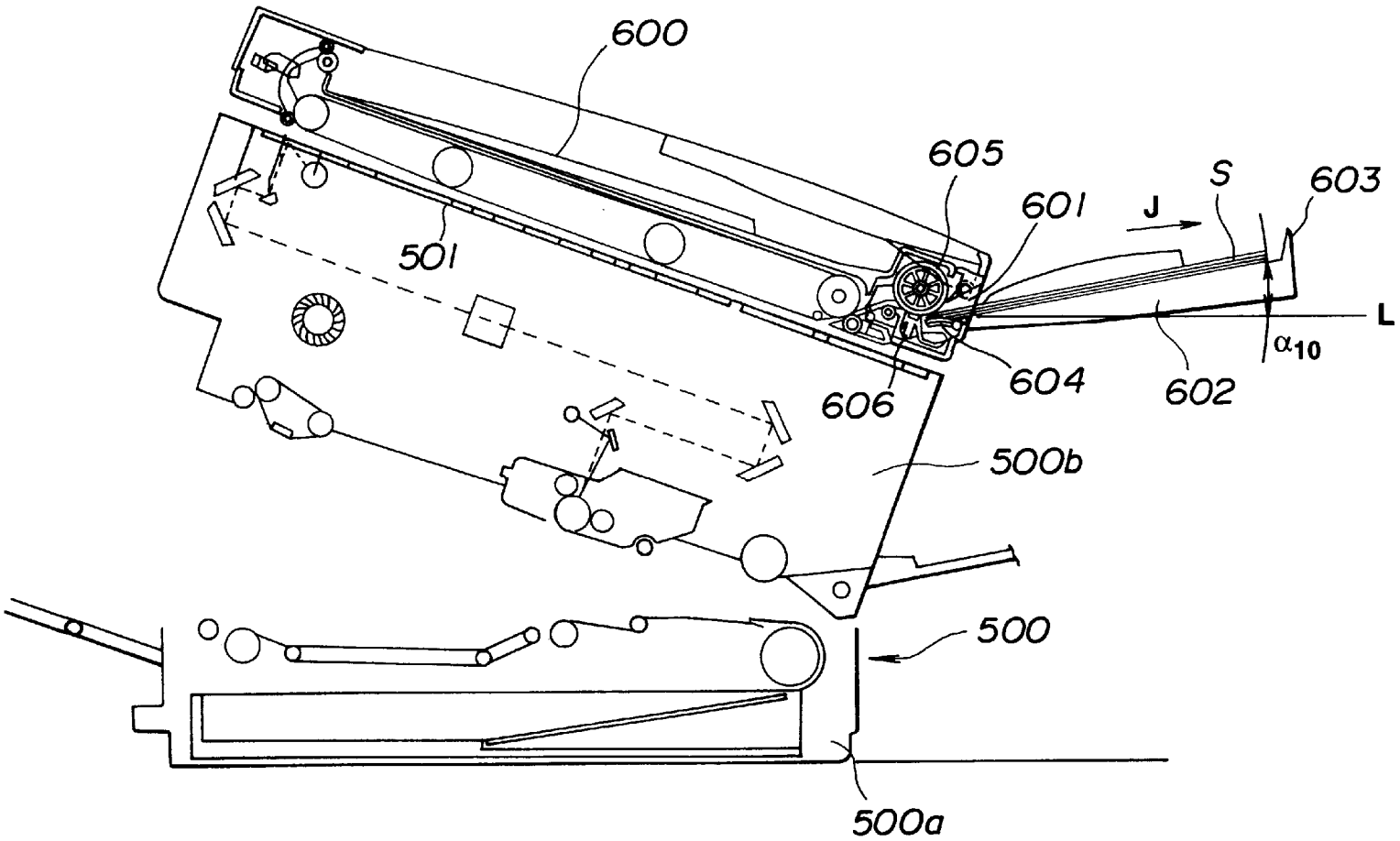
FIG.11 RELATED ART
FIG. 11 is a sectional side view illustrating a conventional approach.

In a copier shown in FIG. 10, a multisheet feeding unit 180 constituting a part of a main body 100 of the copier includes the above-described multisheet feeding device 300, and a vertical path portion 190, serving as means for feeding a sheet material S to an image forming unit 103, which constitutes conveying means 104 within the main body 100 of the copier. The multisheet feeding unit 180 is rotatable between an opened position (indicated by two-dot chain lines) 180*b* and a a closed position (indicated by solid lines) 180*c* relative to the main body 100 of the copier around a hinge 180*a*. Accordingly, when a sheet jam or the like occurs, the multisheet feeding unit 180 present at the closed position 180*c* is moved to the opened position 180*b* by being rotated in the direction of an arrow U by releasing a hook or the like (not shown). At that time, as shown in FIG. 10, respective facing members of a pair of conveying rollers 190*a* and guide members 190*b* constituting the vertical path portion 190 are separated to open the vertical path portion 190. At that time, the angle made by the sheet bundle S on a tray 170 and the horizontal line R1 is β4 in a state in which the rear end of the sheet bundle S is positioned downward from the horizontal line R1 in the opened state. Accordingly, by applying the present invention to the multisheet feeding device 300, serving as the sheet-material feeding device of the copier shown in FIG. 10, even if the multisheet feeding unit 180 is at the opened position 180*b*, i.e., even if the sheet bundle S on the tray 170 is positioned downward from the horizontal line R1 by the angle β4, the sheet bundle S on the tray 170 is in a state of being grasped between a rising member 160 and a feeding member 130. Hence, the drop of the sheet, bundle S from the tray 170 can be prevented.

In the copier shown in FIG. 10, a laser unit 302 exposes an image of an original read by a reading unit 101 onto a photosensitive drum 103*a* of an image forming unit 103.

In each of the above-described embodiments, a description has been provided of a case in which a copier is illustrated as an image forming apparatus, and a sheet-material feeding device according to the present invention is used as the feeding device of the copier. However, the present invention is not limited to such an approach. For example, the same effects can be obtained by applying a sheet-material feeding device according to the present invention as the feeding device of another image forming apparatus, such as a laser-beam printer, a printer, a facsimile apparatus, a scanner or the like.

Although, in the above-described first embodiment, a description has been provided of a method of utilizing a frictional pad as a method for preventing feeding of a plurality of sheets in a sheet-material feeding device, the present invention is not limited to such an approach. For example, the present invention is also effective for sheet-material feeding devices using any other method for preventing feeding of a plurality of sheet, such as a pawl separation method, a retard roller method and the like.

The individual components shown in outline in the drawings are all well known in the sheet-material feeding device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet-material feeding device for individually separating and sequentially feeding a bundle of sheets of a sheet material, the feeding device comprising:

a sheet-material mount without a drop preventing wall;

detection means for detecting a presence of the sheet material on the sheet-material mount;

separating means for separating an individual sheet from the bundle of sheets;

means for changing a sheet-mounting angle of the sheet-material mount so that an upstream portion of the bundle of sheets is moved from a position higher than said separating means to a position lower than said separating means; and pressing means for pressing the sheet material on the sheet-material mount when the presence of the sheet material has been detected by said detection means, and for preventing the sheet material from being displaced from the sheet material mount as a result of movement in an upstream direction when the upstream portion of the bundle of sheets is moved from the position higher than said separating means to the position lower than said separating means.

2. A feeding device according to claim 1, wherein the feeding device is an automatic original-feeding device disposed on an upper frame of an openable image forming apparatus, and wherein the sheet-material mount is displaced when the image forming apparatus is opened.

3. A feeding device according to claim 1, wherein the feeding device is a sheet-material feeding device disposed on an upper frame of an openable image forming apparatus, and wherein the sheet-material mount is displaced when the image forming apparatus is opened.

4. A feeding device according to claim 1, wherein the feeding device is a sheet-material feeding device disposed on a side openable image forming apparatus, and wherein the sheet-material mount is displaced when a side is opened.

5. A sheet-material feeding device for individually separating and sequentially feeding a bundle of sheets of a sheet material, the feeding device comprising:

a sheet-material mount without a drop preventing wall:

a rotating member for feeding the sheet material from the sheet-material mount;

a rising member movable between a pressing position for pressing the bundle of sheets against said rotating member, and a retracted position for releasing the bundle of sheets;

detection means for detecting a supporting state in which the bundle of sheets is supported by the sheet-material mount, and for generating a corresponding detection signal; and means for changing a sheet-mounting angle of the sheet-material mount so that an upstream portion of the bundle of sheets is moved from a position higher than said pressing position to a position lower than said pressing position, wherein said rising member assumes the retracted position when the bundle of sheets is not in the supported state and the pressing position when the bundle of sheets is in the supported state, in accordance with the detection signal from said detection means, and wherein said rising member prevents the sheet material from being displaced from the sheet-material mount as a result of movement in an upstream direction when the upstream portion of the bundle of sheets is moved from the position higher than said pressing position to the position lower than said pressing position.

6. A feeding device according to claim 5, further comprising separation means, disposed downstream from said rising member, for separating and feeding individual sheets of the bundle of sheets in cooperation with said rotating member.

7. A feeding device according to claim 6, wherein said separation means comprises a frictional pad urged against said rotating member by a biasing means.

8. A feeding device according to claim 7, wherein said rising member moves to the retracted position when the individual sheets of the bundle of sheets begin to be separated by said rotating member and said frictional pad.

9. A feeding device according to claim 8, wherein said rising member moves to the pressing position when the individual sheets of the bundle of sheets have been separated.

10. A feeding device according to claim 9, wherein said rising member moves to the pressing position when the feeding device stops an operation due to occurrence of a jam of one or more sheets.

11. A feeding device according to claim 10, wherein, after said device has stopped the operation, a biasing means urges said rising member to remain in the pressing position.

12. An image forming apparatus comprising:

reading means for reading an image of an original; and a main body having an openable/closable member, the openable/closable member including:

a sheet-material mount without a drop preventing wall;

a sheet-material feeding device for individually separating and sequentially feeding to said reading means a bundle of sheets of a sheet material mounted on said sheet-material mount, the device comprising:

a rotating member for feeding the sheet material from the sheet-material mount;

a rising member movable between a pressing position for pressing the bundle of sheets against said rotating member, and a retracted position for releasing the bundle of sheets; and detection means for detecting a supporting state in which the bundle of sheets is supported by the sheet-material mount, and for generating a corresponding detection signal, wherein said rising member assumes the retracted position when the bundle of sheets is not in the supported state and the pressing position when the bundle of sheets is in the supported state, in accordance with the detection signal from said detection means, wherein at least the openable/closable member of said main body including said sheet-material feeding device is rotatable between an opened position and a closed position, and wherein the openable/closable member of said main body rotates in a direction that reduces an angle between the bundle of sheets set on said sheet-material mount and a horizontal plane when rotating from the closed position to the opened position, and wherein said rising member prevents the sheet material from being displaced from the sheet-material mount as a result of movement in an upstream direction when the upstream portion of the bundle of sheets is moved from the position higher than said pressing position to the position lower than said pressing position.

13. An image forming apparatus comprising:

image forming means for forming an image on a sheet material; and a main body having an openable/closable member, the openable/closable member including:

a sheet-material mount without a drop preventing wall;

a sheet-material feeding device for individually separating and sequentially feeding to said image forming means a bundle of sheets of a sheet material mounted on said sheet-material mount, the device comprising:

a rotating member for feeding the sheet material;

a rising member movable between a pressing position for pressing the bundle of sheets against said rotating member, and a retracted position for releasing the bundle of sheets; and detection means for detecting a supported state in which the bundle of sheets is supported by the sheet-material mount, and for generating a corresponding detection signal, wherein said rising member assumes the retracted position when the bundle of sheets is not in the supported state and the pressing position when the bundle of sheets is in the supported state, in accordance with the detection signal from said detection means, wherein at least the openable/closable member of said main body including said sheet-material feeding device is rotatable between an opened position and a closed position, and wherein the openable/closable member of said main body rotates in a direction that reduces an angle between the bundle of sheets set on said sheet-material mount and a horizontal plane when rotating from the closed position to the opened position, and wherein said rising member prevents the sheet material from being displaced from the sheet-material mount as a result of movement in an upstream direction when the upstream portion of the bundle of sheets is moved from the position higher than said pressing position to the position lower than said pressing position.

14. An image forming apparatus according to claim 12 or 13, wherein the openable/closable member of said main body is an upper frame of said main body.

15. An image forming apparatus according to claim 13, wherein the openable/closable member of said main body is a multisheet feeding unit comprising feeding means for feeding the sheet material to said image forming means, the feeding unit being disposed within said the main body.

16. An image forming apparatus according to claim 15, wherein the openable/closable member of said main body includes a conveying path for guiding the sheet material conveyed from a sheet accommodating unit.

17. A sheet-material feeding device for individually separating and sequentially feeding a bundle of sheets of a sheet material, said feeding device comprising:

driving means for transmitting and changing a direction of operation of a driving force;

a rotating member for feeding an individual sheet of the bundle of sheets;

a rising member movable between a pressing position for pressing the bundle of sheets against said rotating member and a retracted position for releasing the bundle of sheets; and a switching mechanism, disposed between said driving means and said rotating member and between said driving means and said rising member, for transmitting the driving force of said driving means to said rotating member and said rising member, said switching mechanism comprising:

a switching member being movable to a first position in accordance with a driving force transmitted by said driving means and rotated in one direction, and to a second position in accordance with a driving force transmitted by said driving means and rotated in another direction;

a sheet-material mount without a drop preventing wall; and means for changing a sheet-mounting angle of the sheet-material mount so that an upstream portion of the bundle of sheets is moved from a position higher than said pressing position to a position lower than said pressing position;

wherein, said rising member presses the sheet material on the sheet-material mount when the presence of the sheet material has been detected by a detection means, and prevents the sheet material from being displaced from the sheet-material mount as a result of movement in an upstream direction when the upstream portion of the bundle of sheets is moved from the position higher than said pressing position to the position lower than said pressing position;

wherein, when said switching member is in the first position, said switching member rotates said rotating member so that said rotating member conveys the sheet from the bundle of sheets in the pressed state, and moves said rising member from the pressing position to the retracted position after a predetermined time period, and, when said switching member is in the second position, said switching member moves said rising member from the retracted position to the pressing position.

18. A feeding device according to claim 17, wherein said switching member comprises a switching gear for revolving around an external circumference of an input gear while simultaneously rotating.

19. A feeding device according to claim 17, wherein said driving means comprises a driving motor capable of performing forward rotation and reverse rotation, and wherein said switching mechanism further comprises:

a driving gear rotating in one of a forward and a reverse direction in accordance with forward rotation and reverse rotation of said driving motor;

a switching gear rotating and meshing with said driving gear and said switching member, and being moveable to a first and second position by a connection arm provided between said switching gear and said driving gear;

a first idler gear for rotating and meshing with said switching gear when said switching gear moves to the first position in accordance with one of forward rotation and reverse rotation of said driving motor;

a second idler gear for rotating and meshing with said switching gear when said switching gear moves to the second position in accordance with one of reverse rotation and forward rotation of said driving motor;

a feeding gear for meshing with said first idler gear and rotatably driving said rotating member by the rotation of said first idler gear in accordance with one of forward rotation and reverse rotation of said driving motor, and by the movement of said switching gear to the first position in accordance with one of forward rotation and the reverse rotation of said driving motor; and a cam gear meshing with said first idler gear and said second idler gear, wherein said cam gear moves said rising member from the pressing position to the retracted position, after a predetermined time period, by the rotation of said first idler gear in accordance with one of forward rotation and reverse rotation of said driving motor and by the movement of said switching gear to the first position, and said cam gear moves said rising member from the retracted position to the pressing position by the rotation of said second idler gear in accordance with movement of said switching gear to the second position.

20. A feeding device according to claim 19, further comprising a frictional pad for forming a separation nip portion with said rotating member, said frictional pad being pressed by said rotating member and being disposed downstream from said rising member in a feeding direction of the sheet material.

21. A feeding device according to claim 19, wherein said cam gear comprises a cam, and wherein said rising member includes a cam follower urged against said cam by a biasing member.

22. A sheet-material feeding device according to claim 1, wherein said pressing means moves to a retracted position when individual sheets of the bundle of sheets begin to be separated by said separating means.

23. A sheet-material feeding device according to claim 22, wherein said pressing means moves to a pressing position after individual sheets of the bundle of sheets have been separated.

24. An image forming apparatus comprising:

reading means for reading an image of an original; and a main body having an openable/closable member, the openable/closable member including:

a sheet-material feeding device disposed on an upper portion of the openable/closable member and for individually separating and sequentially feeding to said reading means a bundle of sheets of a sheet material mounted on a sheet-material mount, said sheet-material mount without a drop preventing wall, the device comprising:

detection means for detecting a presence of the sheet material on the sheet-material mount;

separating means for separating an individual sheet from the bundle of sheets;

pressing means for pressing the sheet material on the sheet-material mount when the presence of the sheet material has been detected by said detection means, and for preventing the sheet material from being displaced from the sheet-material mount as a result of movement in an upstream direction when an upstream portion of the bundle of sheets is moved from a position higher than said separating means to a position lower than said separating means;

wherein at least the openable/closable member of said main body including said sheet-material feeding device is rotatable between an opened position and a closed position, and wherein the openable/closable member of said main body rotates in a direction that reduces an angle between the bundle of sheets set on said sheet-material mount and a horizontal plane when rotating from the closed position to the opened position.

25. An image forming apparatus according to claim 24, wherein said pressing means moves to a retracted position when individual sheets of the bundle of sheets begin to be separated by said separating means.

26. An image forming apparatus according to claim 25, wherein said pressing means moves to a pressing position after individual sheets of the bundle of sheets have been separated.

27. A sheet-material feeding device according to claim 1, wherein the sheet-material feeding device is contained within an apparatus and the sheet-material mount extends outside of said apparatus.

28. A sheet-material feeding device according to claim 5, wherein said rising member has a frictional member.

29. A sheet-material feeding device according to claim 5, wherein said sheet-material feeding device is contained within an apparatus and said sheet-material mount extends outside of said apparatus.

30. An image forming apparatus according to claim 12, wherein the rising member has a frictional member.

31. An image forming apparatus according to claim 12, wherein said sheet-material mount extends outside of said image forming apparatus.

32. An image forming apparatus according to claim 13, wherein said rising member has a frictional member.

33. An image forming apparatus according to claim 13, wherein said sheet-material mount extends outside of said image forming apparatus.

34. A sheet-material feeding device according to claim 17, wherein said rising member has a frictional member.

35. A sheet-material feeding device according to claim 17, wherein said sheet-material feeding device is contained within an apparatus and said sheet-material mount extends outside of said apparatus.

36. An image forming apparatus according to claim 24, wherein said sheet-material mount extends outside of said image forming apparatus.

* * * * *

UNITED STATES PATENT AND TRADEMARK OFFICE

CERTIFICATE OF CORRECTION

PATENT NO. : 6,224,052 B1
DATED : May 1, 2001
INVENTOR(S) : Toshiyuki Nagano

It is certified that error appears in the above-identified patent and that said Letters Patent is hereby corrected as shown below:

Title page,
Item [57], ABSTRACT,
Line 8, "detetector." should read -- detector --.

Column 3,
Line 56, "apparatous." should read -- apparatus --.

Column 4,
Line 18, "and" should read -- and FIG. 3, --.

Column 7,
Line 46, "G7;" should read -- G 7, --.
Line 47, "and the" should read -- the --.

Column 8,
Line 16, "one way" should read -- one-way --.

Column 9,
Line 16, "reverse;" should read -- reverse --.

Column 11,
Line 55, "embodiment.," should read -- embodiment, --.

Column 13,
Line 35, "above described" should read -- above-described --.
Line 54, "a a closed" should read -- a closed --.

UNITED STATES PATENT AND TRADEMARK OFFICE

CERTIFICATE OF CORRECTION

PATENT NO. : 6,224,052 B1
DATED : May 1, 2001
INVENTOR(S) : Toshiyuki Nagano

It is certified that error appears in the above-identified patent and that said Letters Patent is hereby corrected as shown below:

Column 14,
Line 31, "sheet," should read -- sheets, --.

Signed and Sealed this

Twenty-second Day of January, 2002

*Attest:*

*Attesting Officer*

JAMES E. ROGAN
*Director of the United States Patent and Trademark Office*